United States Patent [19]

Pillai

[11] Patent Number: 4,872,423

[45] Date of Patent: Oct. 10, 1989

[54] METHOD FOR IMPROVING UTILIZATION OF SULPHUR-ABSORBENT WHEN BURNING FUEL IN A FLUIDIZED BED AND A POWER PLANT IN WHICH FUEL IS BURNED IN A FLUIDIZED BED

[75] Inventor: Krishna K. Pillai, Finspong, Sweden

[73] Assignee: ABB Stal AB, Finspong, Sweden

[21] Appl. No.: 171,598

[22] Filed: Mar. 22, 1988

[30] Foreign Application Priority Data

Mar. 25, 1987 [SE] Sweden ..... 8701229

[51] Int. Cl.[4] ..... F22B 1/00

[52] U.S. Cl. ..... 122/4 D; 110/245; 110/342; 110/345

[58] Field of Search ..... 122/4 D; 110/245, 347, 110/346, 342, 343, 345

[56] References Cited

U.S. PATENT DOCUMENTS

| | | | |
|---|---|---|---|
| 4,185,080 | 1/1980 | Rechmeier . | |
| 4,312,280 | 1/1982 | Shearer et al. . | |
| 4,421,036 | 12/1983 | Brannstrom et al. . | |
| 4,640,205 | 2/1987 | Branstrom . | |
| 4,730,563 | 3/1988 | Thornblad | 122/4 D |
| 4,753,180 | 6/1988 | Narisoko et al. | 122/4 D X |

FOREIGN PATENT DOCUMENTS

| | | |
|---|---|---|
| 0132061 | 6/1984 | European Pat. Off. . |
| 435545 | 1/1984 | Sweden . |
| 2143148 | 6/1984 | United Kingdom . |

*Primary Examiner*—Edward G. Favors

*Attorney, Agent, or Firm*—Pollock, Vande Sande & Priddy

[57] ABSTRACT

A method for improving utilization of sulphur-absorbent when burning fuel in a fluidized bed of particulate material includes withdrawing partially consumed bed material from the ash chamber of the bed vessel and returning to the combustion chamber of the bed by means of pneumatic transportion using steam as propellant. The steam constitutes a reactant which effects disintegration of the bed-material particles. A power plant burning a fuel in a fluidized bed of particulate material comprises a bed vessel having an air distributor with nozzles for supplying air to a combustion chamber to effect fluidization of the bed and combustion of a fuel. An ash chamber is provided below the air distributor for removal of ash and bed material, and transport means for withdrawing partially consumed bed material from the ash chamber, treating this bed material with steam and returning the steam-treated bed material to the combustion chamber.

4 Claims, 2 Drawing Sheets

METHOD FOR IMPROVING UTILIZATION OF SULPHUR-ABSORBENT WHEN BURNING FUEL IN A FLUIDIZED BED AND A POWER PLANT IN WHICH FUEL IS BURNED IN A FLUIDIZED BED

BACKGROUND OF THE INVENTION

The present invention relates to a method for improving utilization of sulphur-absorbent and thus the consumption of sulphur-absorbent when burning sulphur-containing coal in a fluidized bed of particulate material containing material which, upon combustion, combines with sulphur and prevents sulphur oxides from being dispersed into the environment with the fuel gases produced at the combustion. The sulphur-absorbent normally consists of a calcium compound, usually calcium ($CaCO_3$) or dolomite ($CaCO_3 . MgCO_3$) or a mixture thereof. Hydrated calcium sulphate is a stable compound which can be deposited into the environment without risk of its causing damage.

The invention also relates to a power plant burning coal in a fluidized bed of particulate material in the combustion chamber of a bed vessel. It is particularly intended for power plants in which combustion occurs at a pressure considerably in excess of atmospheric pressure and the combustion gases are used to drive a gas turbine, and where steam is generated to drive a steam turbine.

A number of chemical reactions are obtained at the temperature prevailing in the bed at combustion (800°-950° C.). The absorbent particles are converted partially to calcium oxide (CaO) and sulphated, and a surface layer of hydrated calcium sulphate is formed. Gradually, an absorbent ($CaSO_4$) and a core of $CaCO_3$ and/or CaO. The outer layer of calcium sulphate ($CaSO_4$) impedes the diffusion of sulphur in to the unused absorbent and limits utilization of the absorbent material. In order to improve the level of utilization it is known to remove bed material from the bed and crush the particles so that the calcium sulphate layer is disintegrated and the unconsumed bed material inside the particles is exposed. The crushed bed material is returned to the bed and the unused absorbent material in the bed particles is accessible for absorption of sulphur.

SUMMARY OF THE INVENTION

The present invention involves a new method of making the interior of the absorbent particles accessible for absorption when a surface layer of calcium sulphate has formed on the particles and prevents diffusion. According to the invention the bed material is withdrawn from the fluidized bed and mixed with steam. Calcium oxide (CaO) and calcium hydroxide ($CaCO_3$) in the hot bed material react with the steam as follows $$CaO + H_2O \rightarrow Ca(OH)_2 + 66 \text{ kJ/g-mol}$$

$$CaCO_3 + H_2O \rightarrow Ca(OH)_2 + CO_2 - 112 \text{ kJ/g-mol}$$

These reactions are sufficiently violent to shatter the bed material particles. Unconsumed absorbent material inside the particles is exposed and becomes accessible for absorption. The calcium hydroxide ($Ca(OH)_2$) thus formed is an extremely fine-grained powder. $Ca(OH)_2$ is a good sulphur absorbent and has high reactivity in powder form thanks to the large reaction surface available. The following reaction is obtained:

$$Ca(OH)_2 + SO_2 + \tfrac{1}{2} O_2 \rightarrow CaSO_4 + H_2O + 435 \text{ kJ/g-mol}$$

At temperature below 640° C. calcium hydroxide ($Ca(OH)_2$) is always in the form of a solid substance. At temperatures above about 640° C. liquid phases may be formed. This may cause particles to adhere to each other, forming lumps which clog the transport pipe. It is therefore advisable to cool the bed material withdrawn to a temperature of below 640° C. before allowing it to react with the steam.

The reaction of the bed material withdrawn may occur in a pneumatic transport pipe and an ash chamber below a combustion chamber in a bed vessel. Steam is supplied through an ejector nozzle in the transport pipe and is utilized as transport gas. The transport pipe may be provided with means to extend the transport time, and thus the time during which steam can react with the particles of the bed material.

BRIEF DESCRIPTION OF THE DRAWINGS

The invention will be described more fully with reference to the accompanying drawings.

DESCRIPTION OF A PREFERRED EMBODIMENT

Figure 1:
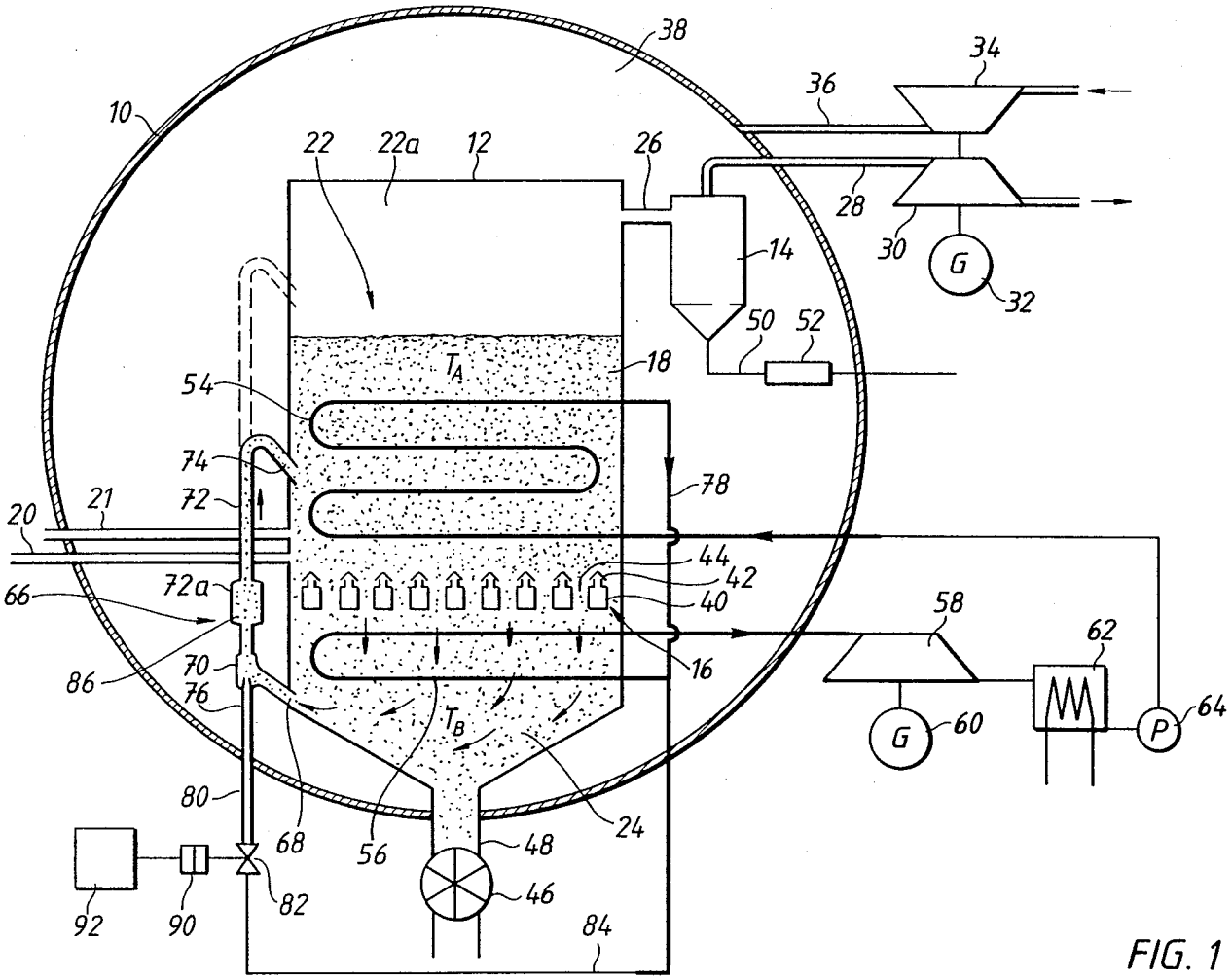
FIG. 1 shows the invention utilized in a PFBC power plant.
Figure 2:
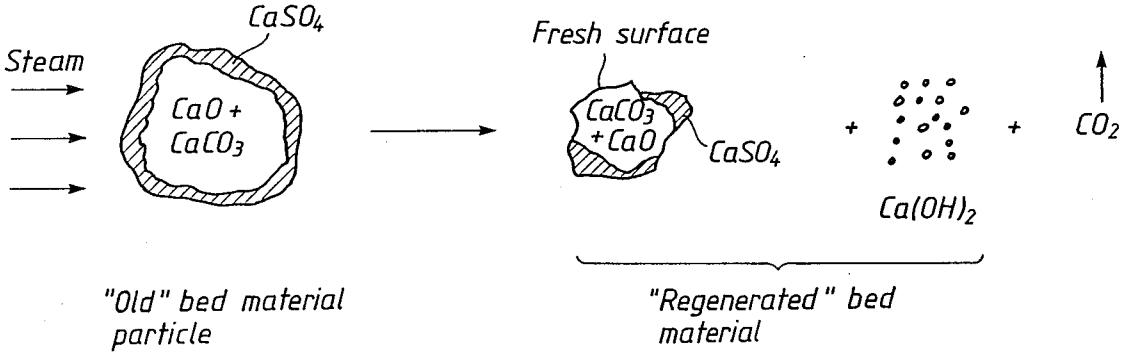
FIG. 2 shows schematically what happens with a hot bed particle upon contact with steam.

In the drawings, 10 designates a pressure vessel. A bed vessel 12 and gas-cleaning plant symbolized by a cyclone 14 are arranged in the pressure vessel. In practice the gas cleaning plant comprises parallel-connected groups of series-connected cyclones. In the lower part of the bed vessel 12, a distributor 16 is located disperse air for fluidization of a bed 18 of particle material and combustion of a fuel supplied to the bed 18 through a fuel-supply pipe 20. Fresh bed material is added to the bed vessel 12 through a pipe 21. The air distributor divides the bed vessel 12 into an upper combustion chamber 22 and a lower ash chamber 24. The upper part of the combustion chamber 22 forms a free-board 22a where combustion gases from the bed 18 collect. These gases are conducted from the free-board 22a via conduit 26 to the cyclone 14. Dust separated in the cyclone 14 is removed through pipe 50 and a pressure-reducing dust discharge device 52 for collection in a container outside the pressure vessel. The cleaned gas is conducted through the pipe 28 to a gas turbine 30 which drives a generator 32 and a compressor 34. This compressor compresses combustion air which is supplied through the pipe 36 to the space 38 between pressure vessel 10 and bed vessel 12. The air distributor 16 is constructed of elongate distribution chambers 40 with nozzles 42. Air for fluidization and combustion is supplied to these distribution chambers 40 from the space 38 via valve members or dampers, not shown, which determine the air flow. The distribution chambers 40 from slits or apertures 42 through which bed material can flow from the bed 18 in the combustion chamber 22 to the ash chamber 24. The bed material, sulphur absorbent and residual products from the combustion are removed from the ash chamber through the cell-feeder 46 in discharge pipe 48.

Tubes 54 are provided in the bed 18 in the combustion chamber 22, to generate steam and to cool the bed, and tubes 56 are provided in the ash chamber 24 for superheating this steam. The steam drives a steam turbine 58 and a generator 60 connected thereto. The steam leaving the turbine 58 is condensed in a condenser 62 and the condensate is returned by the feed-water pump 64 to the tubes 54 in the bed 18.

The plant is provided with a means for disintegrating the bed material particles in order to expose the unused absorbent in their interior. The disintegrated bed mass is returned to the bed where the absorbent, previously difficult to access, has now become easily accessible and its absorption function is effectivized. The bed material is treated with steam in order to disintegrate it. As shown in FIG. 1, the treating means 66 consists of a pneumatic transport means 66 for returning bed material from the ash chamber 24. Steam is used as transport gas. This transport means 66 includes a suction nozzle 68 connected to the ash chamber 24, an ejector 70, a pipe 72 and a supply nozzle 74. The orifice of this nozzle may be located in the combustion chamber 22 in the bed 18, or in the free-board **22*a* above the bed 18. The ejector nozzle 76 is connected to steam conduit 78 via pipe 80, valve 82 and conduit 84. The transport pipe 72 may have an enlarged portion 72*a* forming a chamber 86 which extends the time spent in the transport pipe 72. The time spent by the bed material in the steam atmosphere is thus extended. The quantity of material circulated through the transport means, treated with steam and returned from the ash chamber 24 to the combustion chamber 22 is regulated by the flow of steam to the ejector nozzle 76. The steam flow is regulated by valve 82, which has a control device 90 connected to a regulating device 92. The requisite steam pressure is determined by the pressure in the combustion chamber 18 and by the quantity of material to be circulated The pressure must be slightly in excess of the pressure in the combustion chamber 18. The steam conduit 84 may also include a reducer valve to reduce the pressure of the steam withdrawn from the conduit 78**. The temperature of the steam should be above 200° C. but should not exceed the temperature $T_B$ of the bed material withdrawn.

As mentioned, the temperature of the bed material treated with steam should be less than about 640° C. The material in the bed 18 in combustion chamber 22 has a temperature $T_A$ of 800°-950° C. When the falling bed material has passed the tubes 56 in the ash chamber 24, it will have been cooled to a temperature considerably below 640° C. and may lie within the interval 300°-500° C.

The reaction when treating bed material is illustrated in FIG. 21. When a particle comes into contact with steam, CaO and $CaCO_3$ will react with water to form $Ca(OH)_2$ in the form of a fine powder, and $CO_2$ is released. The surface layer of $CaSO_4$ is disintegrated, thus exposing unconsumed absorbent in the interior of the particles. $Ca(OH)_2$ is obtained, as mentioned, in the form of a fine powder and a large effective surface is obtained making the powder extremely efficient as an absorbent. It will therefore be well utilized even if the time of remaining in the bed 18 is short.

I claim:

1. A power plant burning a fuel, primarily sulphur-containing coal, in a fluidized bed of particular material comprising:

a bed vessel;

an air distributor with nozzles for blowing air into the bed vessel to effect fluidization of the bed material and combustion of a fuel supplied to the bed, said air distributor dividing the bed vessel into a combustion chamber and an ash chamber;

openings in the air distributor for permitting the bed material to flow from the combustion chamber to the ash chamber;

means in the combustion chamber for cooling the bed material and generating steam;

means for cooling bed material in the ash chamber;

means for withdrawing partly evoled bed material from said ash chamber;

a pneumatic transport means for transporting said withdrawn bed material to said combustion chamber; and means for supplying said pneumatic transport means with steam constituting both transport gas and a reactant to effect disintegration of absorbent particles.

2. A power plant according to claim 1 further comprising an ejector in said pneumatic transport means connected to a steam source through a valve for controlling the bed material flow from said ash chamber to said combustion chamber.

3. A power plant according to claim 1, wherein said transport means is provided with an enlarged portion or chamber which extends the time spent by the bed material in steam atmosphere.

4. A method of improving utilization of a sulphur absorbent containing calcium (Ca) forming at least partially a bed material in a bed vessel with a combustion chamber located above an air distributor for combustion of a fuel in a fluidized bed by disintegrating absorbent particles covered by calcium sulfate such that the unused absorbent in the particles is released, comprising the steps of:

cooling the bed material in a space below the air distributor to a temperature below about 650° C.;

withdrawing cooled bed material comprising partly utilized, partly unused absorbent particles from the space below the air distributor; and pneumatically returning said bed material to the combustion chamber above the air distributor by a pneumatic transport means driven by steam;

wherein the steam constitutes both transport gas and a reactant to effect disintegration of the bed material particles.

* * * * *